United States Patent [19]

Gravouia, Jr. et al.

[11] Patent Number: 4,625,381

[45] Date of Patent: Dec. 2, 1986

[54] FLOATING WEAR BUSHING RETRIEVER APPARATUS

[76] Inventors: Francis Gravouia, Jr., 406 Acorn St., Lafayette, La. 70507; Henry Hebert, Rte. #3, Box 100, Carencro, La. 70520

[21] Appl. No.: 257,175

[22] Filed: Apr. 24, 1981

[51] Int. Cl.[4] ..... E21B 17/12

[52] U.S. Cl. ..... 29/283; 166/85; 294/86.1

[58] Field of Search ..... 29/283, 278, 280, 281, 29/254, 255, 275; 285/39, 376, 402; 166/85; 175/315; 294/86.2, 86.21, 86.1, 86.24

[56] References Cited

U.S. PATENT DOCUMENTS

| | | | |
|---|---|---|---|
| 1,128,634 | 2/1915 | Talbot | 285/402 |
| 1,873,294 | 8/1932 | Cosgrove | 29/254 |
| 2,339,258 | 1/1944 | Engh | 29/255 |
| 2,506,795 | 5/1950 | Koeln | 294/86.1 |
| 2,662,276 | 3/1950 | Sheaffer | 29/255 |
| 3,489,214 | 1/1970 | Phipps et al. | 166/85 |

*Primary Examiner*—Frederick R. Schmidt
*Assistant Examiner*—Steven P. Schad
*Attorney, Agent, or Firm*—Keaty & Keaty

[57] ABSTRACT

An apparatus which provides for a sub-body having a mandrel with a longitudinal bore therethrough having a rigidly attached upper collar section for engagement onto a section of pipe or the like, and having a threadably removable lower collar section for threadably engaging the end of a second lower section of drill pipe. Insertable onto the mandrel or body section of the sub-unit is a retriever section, which is substantially circular in nature and slidably movable between the end collars of the sub-unit. The retriever section is adapted with protruding members, radially around its exterior most vertical wall for engaging with an extended J-slot of a wear bushing following the lowering of the retrieving unit into the bushing. Also provided is a pair grooved sections running substantially the length of the mandrel section of the sub-unit on both sides of the mandrel, wherein a intruding member on the retriever unit may move along the vertical body, but is disallowed for rotational movement thereupon. An alternate embodiment would include exterior threads for threadably engaging the wear bushing to be retrieved.

9 Claims, 6 Drawing Figures

FIG. 1
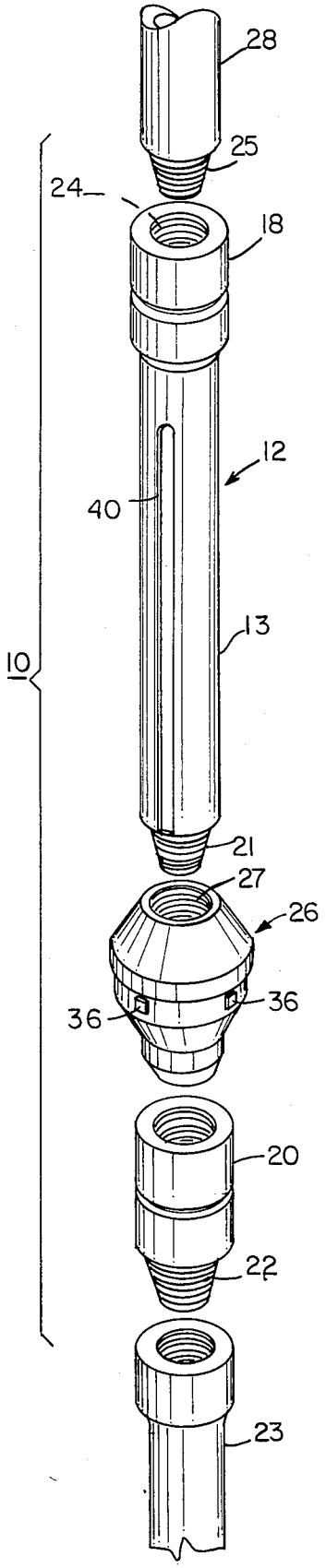
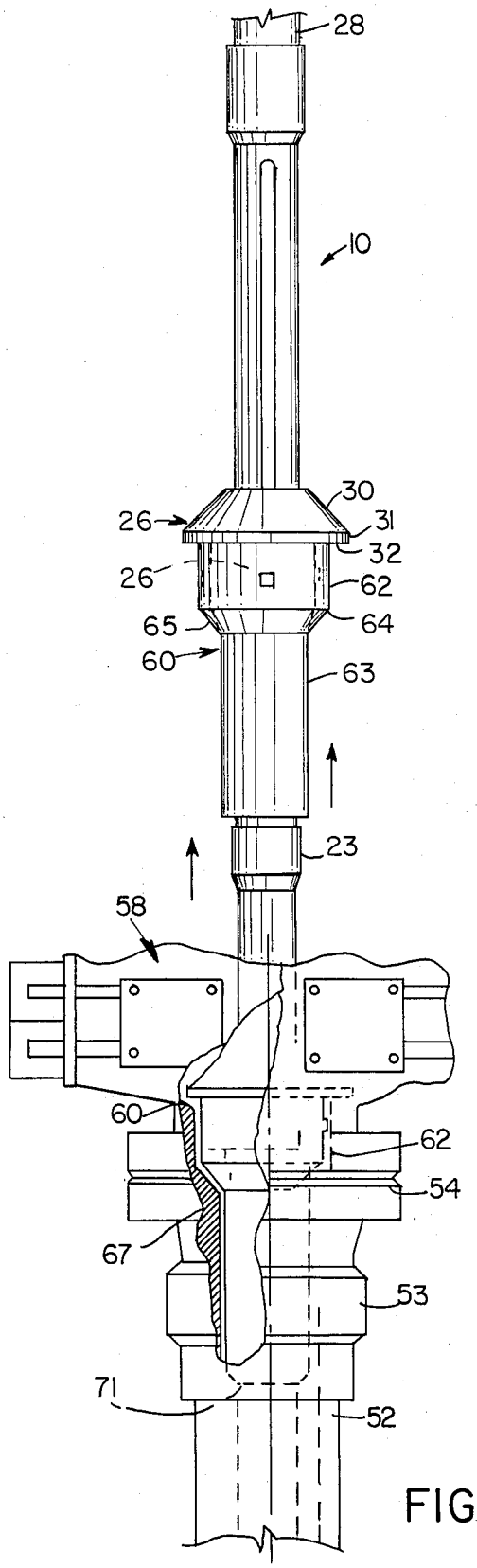
FIG. 2

FLOATING WEAR BUSHING RETRIEVER APPARATUS

BACKGROUND OF THE INVENTION

1. Field of the Invention

The present invention relates to oil well drilling tools and apparatuses. More particularly, the present invention relates to an apparatus for retrieving the wear bushing from around the interior of the well head and casing, including a sub-unit for mounting there onto the drill string.

2. General Background

Wear sleeves or wear bushings, as they are called, are utilized during oil and gas well drilling and other operations on wells to protect against excessive wear, in particular, the wear bushings prevent wear to seal areas of casing heads and other well head elements, including the joint of the housing and the initial length of pipe or casing to which it is secured.

In U.S. Pat. No. 3,747,914 issued to Slack, the wear sleeve is equipped with an interior bore smaller in diameter than the width of the bit so that the sleeve may be somewhat loosely incorporated on the drill string, resting on the drill bit and lowered to its position in order to operate as a drill string is run into the hole and retrieved from the bit as the bit is withdrawn following the drilling process. However, often times it may be desirable to retrieve the wear sleeve or bushing without the use of the bit. For example, when the drill pipe is lodged, the pipe may be backed off above the drill bit and withdrawn from the hole leaving the drill collar and bit itself down in the hole.

In order to retrieve the drill collars and bit, it is necessary to wash over with a wash over string larger in inside diameter than the outside diameter of the drill collar and equal to that of the bit itself. Due to the size, the aforementioned equipment will not go through a normal wear sleeve, and it becomes necessary to remove the wear sleeve or bushing.

One of the methods utilized in the present state of the art, as exhibited in U.S. Pat. No. 3,489,214 issued to Phipps, et al, the removal of the wear sleeve or bushing in those instances when removal of the bit is undesirable or impossible as taught. One would use a wear sleeve or bushing section providing with what is called a J-slot and a retriever body having outwardly protruding dowels or the like for engaging the J-slot. The dowels or the like would protrude around the entire radias of the retriever body. This retriever is incorporated in the drill string with the usual pin and box threaded upper and lower ends. In the preferred embodiment, the tool is a body having a longitudinally through bore large enough to pass over the upset end of a pipe, a plurality of segmental split sleeves slidably into the bore of the end facing away from the pipe upset end; means defining a lineable opening radially through the body in splits sleeves; the split sleeves having lower end surfaces adapted to seat on the rear of the pipe upset end; screws threadably advancable in said openings, partly through the body, and to the respective sleeves and into engaging with the exterior of the pipe to secure the two together and prevent its rotation with respect to the pipe. Protruding means such as radial projecting pins are provided on the tool for engaging a cooperating means on the wear sleeve or similar element.

One of the short comings of this particular apparatus as taught in U.S. Pat. No. 3,489,241 is the fact that the retriever body must be secured in rigid engagement with the exterior of the pipe so that it will not rotate with respect to the pipe. This shortcoming shall be discussed in the latter sections of this application.

GENERAL DISCUSSION OF THE PRESENT INVENTION

The present invention would solve the problems in the present state of the art in a simple and inexpensive, straight-forward manner. The apparatus of the present invention provides for a sub-body having a mandrel with a longitudnal bore therethrough having a rigidly attached upper collar section for engagement onto a section of pipe or the like, and having a threadably removable lower collar section for threadably engaging the end of a second lower section of drill pipe, insertable onto the mandrel or body section of the sub-unit is a retriever section, which is substantially circular in nature and slidably movable between the end collars of the sub-unit. The retriever section is adapted with means, for example, protruding members, radially around its exterior most vertical wall for engaging with an extended J-slot of a wear bushing following the lowering of the retrieving unit into the bushing. Also provided is a pair grooved sections running substantially the length of the mandrel section of the sub-unit on both sides of the mandrel, wherein a an insertion member on the retriever unit is slidably engaged, so that the retriever unit may move along the vertical body, but is disallowed for rotational movement thereupon.

Thus, it is an object of the present invention to provide a retrieving tool which is removably securable on the exterior surface of a sub-unit so that it may be mounted on a string of drill pipe independently of threading on the pipe.

It is a further object of the present invention to provide a retriever apparatus for a wear bushing inside the casing head for allowing vertical movement of the retrieving unit yet allowing rotational movement of the retriever unit during the operation of the apparatus.

It is a further object of the present invention to provide a retriever unit which may be mounted onto a mandrel and connected onto drill pipe and allow a vertical play or movement of the retriever unit in order to prevent damage to the retriever unit or the wear bushing or both due to excessive weight below retriever.

It is still a further object of the present invention to provide a wear bushing retriever apparatus which can be threadably engaged between any two sections of drill pipe without retrieval of the drill bit from the hole.

It is still a further object of the present invention to provide a wear bushing retriever apparatus which is easily removable and installable for quickly removing the wear bushing during the drilling operation.

It is still a further object of the present invention to provide an embodiment of the retriever apparatus to retrieve the bushing by threadably engaging the bushing.

BRIEF DESCRIPTION OF THE DRAWINGS

FIG. 1 illustrates the disassembled apparatus of the preferred embodiment of the present invention between 2 sections of drill pipe;

FIG. 2 is a side, partial cut-away view of the apparatus of the present invention illustrating the wear bushing in position (phantom) inside the well head, and the wear bushing as retrieved by the apparatus;

DETAILED DESCRIPTION OF THE PREFERRED EMBODIMENT

Figure 3:
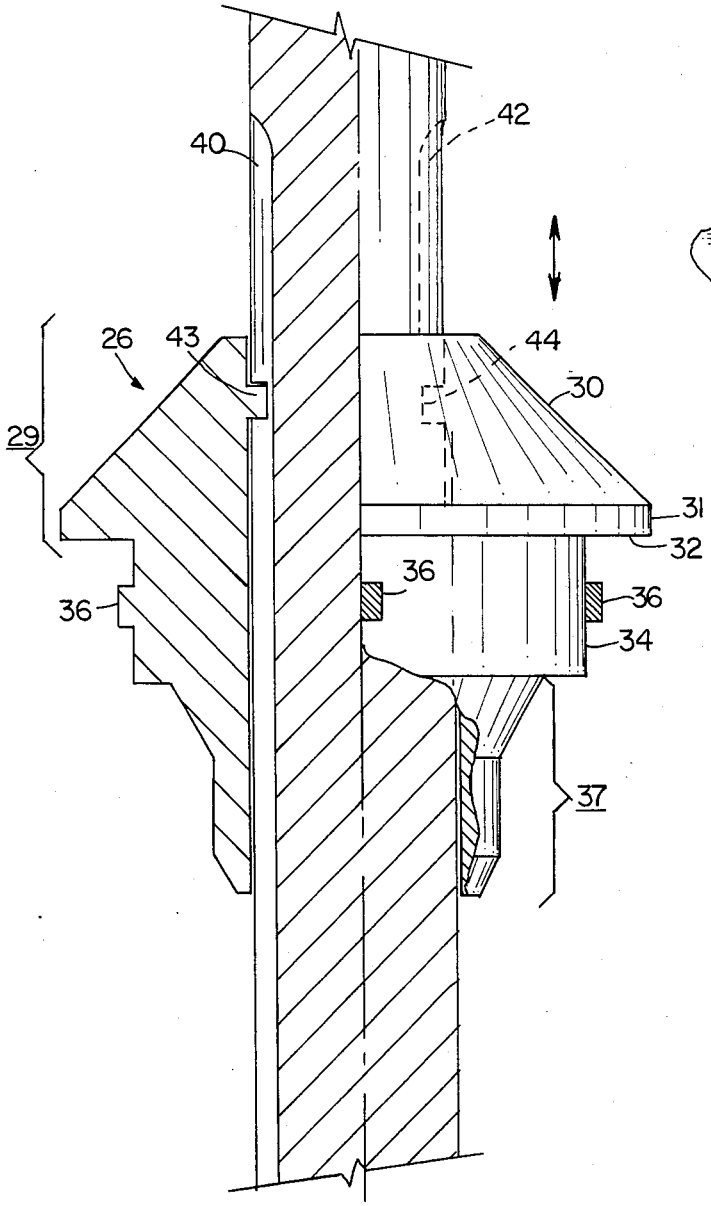
FIG. 3 illustrates a side cut-away view of the retriever section of the apparatus of the present invention slidably engaged into the double grooved mandrel portion of the sub-unit section.

FIGS. 1 through 4 illustrate the preferred embodiment of the wear bushing retriever section and sub-unit comprising apparatus 10 of the present invention. In the preferred embodiment, apparatus 10 comprises sub-unit 12 having a mandrel section 13, extending the greater length of sub-unit 12. At the first end of sub-unit 12 is enlarged collar section 18, integrally attached to the upper end of mandrel section 13, and at the lower end of mandrel section 13 is removably engaged collar section 20, which is threadably engaged to male portion 21 of mandrel section 13 of sub-unit 12. As is further illustrated in FIG. 1, enlarged collar section 20 has male portion 22 for threadably engaging with a lower section of drill pipe 23. The upper end of sub-unit 12 threadably engages the male end 25 of drill pipe 28. Thus, the sub-unit 12, during operation, as will be discussed further, may be placed between any two sections of drill pipe along the drill string in FIG. 1 represented by pipe sections 23 and 28.

The sub-unit 12, in the preferred embodiment, would have a longitudinal bore 24 therethrough so that the flow of material through the drill string is not obstructed when sub-unit 12 is in position. Also, the exterior diameter of the mandrel section 13 and collars 18 and 20 are equivalent to a section of drill pipe, so that when sub-unit 12 is in place along the drill string, its exterior diameters are no greater than the exterior diameter of the drill string itself.

The complete apparatus 10, as illustrated in FIG. 1, also includes retriever section 26. Retriever section 26 is substantially circular in shape having a bore 27 therethrough for fitting around mandrel section 13. In the preferred embodiment, the interior diameter of bore 27 of retriever section 26 is slightly larger than the exterior diameter of mandrel section 13, so that upon placement of retriever section 26 around mandrel 13, the retriever section 26 is able to slide easily along substantially the entire length of mandrel section 13. This feature is crucial and will be explored more fully further.

In order to position retriever section 26 onto mandrel section 13, lower collar 20 must be removed since the interior diameter of bore 27 of retriever section 26 is substantially less than the exterior diameter of lower collar 20. In fact, in operation, lower collar 20 serves to maintain retriever section 26 along the length of the mandrel section 13, and prevents retriever section 26 from sliding off a lower end of sub-unit 12.

As is illustrated in FIGS. 1 and 3, retriever section 26 comprises upper angular wall portion 30, which integrally attaches to upper vertical wall 31 to form essentially the upper portion of the retriever section 26, which serves as a "cap" or hub portion 29 of retriever section 26. Integrally attached to the shoulder portion 32 of the upper section of retriever section 26 is vertical wall portion 34, which, in operation, would be of sufficient exterior diameter to fit into the interior diameter of a wear bushing during the retrieval or replacement process.

In the preferred embodiment, vertical wall 34 would be adapted with a plurality of protruding members 36, preferably four, which would be equally spaced around the exterior of wall 34, and protruding therefrom as seen in FIGS. 1 and 3. These protrusions 36 serve to engage the wear bushing to be retrieved, as will be discussed further. The lower portion 37 of retriever section 26 serves primarily to guide the retriever section 26 into the opening of the wear bushing to be retrieved.

Also illustrated in FIG. 1, are groove portions 40 and 42 along the exterior surface of mandrel 13. (Groove portion 42 is not shown in FIG. 1 since it is around the far side of the mandrel 13.) Grooves 40 and 42 would extend substantially the entire length of mandrel sections 13. Grooves 40 and 42, as illustrated in exploded in FIG. 3, serve to slidably accommodate insertion members 43 and 44 (illustrated in FIG. 3 in phantom view) located on the inner wall of bore 27 of retriever section 26. Thus, retriever section 26 is free to move vertically along mandrel section 13, yet prevented from freely rotating around mandrel section 13, due to the engagement of insertions 43 and 44 in grooves 40 and 42 respectively. However, with rotation of sub-unit 12, rotation is imparted to retriever section 26 during operation of apparatus 10, said rotation which is critical to the success of the apparatus during operation.

OPERATION OF FLOATING RETRIEVER APPARATUS

During the drilling process, a drill string is comprised of a series of drill pipe sections threadably engaged to one another culminating in the drill bit at the bottom of the hole. The drill string, as illustrated in FIG. 2, by sections 23 and 28 is set within interior casing 52, the upper most end of the casing head 53 which is connected at the well head area 54. Above the well head 54, as further illustrated in FIG. 2, is blow-out preventer stack 58 (shown in partial view), for use in the event of a blow-out in the well. It is through this configuration of connections between the casing head 53 and the well head 54 and blow-out preventer 58, that the string of drill pipe sections 23 and 28 (for example) rotate during the drilling process. It is critical therefore, that the rotation of the drill pipe, which can be at very high RPM's, does not make contact with the surfaces in the well head 54 in order to prevent damage to the well head area. In order to prevent this possible contact, there is positioned a wear bushing or collar 60 as shown in partial phanthom in FIG. 2 and in operating position and in total view after being retrieved. A wear bushing is essentially a metal collar which is seated in that area between the drill pipe 23 and the well head 54, and serves to take the wear as the drill pipe 23 is rotated during the drilling process. As seen in FIG. 2, the construction of wear bushing 60 is an enlarged collar section 62, tapering to a long body section 63. The exterior of the wear bushing undergoes a reduction of diameter at 64 below collar 62, providing a downwardly facing circumferential seat at 65, the length of the wear bushing and the positioning of the seat 65, being such that when the wear bushing 60 has been lowered to its operating position, the seat 65 rests on the head through a bore surface 67, and the collar 62 projects upwardly into the lower end of the bore of the blow-out preventer 58 to protect this region and projects downwardly past the casing head to pipe connection at 71.

Due to the constant rotation of the drill string within the wear bushing 60, the bushing 60 will become worn to a point that replacement is necessary, thus the wear bushing 60 must be retrieved out of its operating position and brought up out of the hole in order to be replaced.

In retrieving wear bushing 60, sections of pipe 23 and 28 would be disassembled as in FIG. 1, so that apparatus 10 could be threadably engaged therebetween. Retriever section would be placed upon mandrel section 13, with insertion members 43 and 44 located on the inner surface of bore 27 of retriever section 26 being slidably engaged into grooves 40 and 42 on mandrel 13 respectively. The lower collar portion 20 of mandrel 13 would then be threadably engaged to the lower end of mandrel 13, and the entire apparatus 10 would then be threadably assembled onto the drill string itself as seen in FIG. 2. Upon placement of the apparatus onto the drill string, the drill string would then be relowered into the hole, until the retriever section makes contact with wear bushing 60, as seen in FIG. 2. As explained earlier, the lower portion of retriever section 26 would fit into that space between the drill pipe 23 and the interior most wall of the collar portion 62 of wear bushing 60.

Figure 4A:
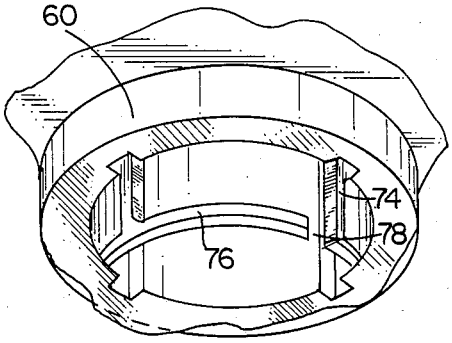
FIGS. 4A and 4B illustrate an exploded cut-away side view and top view respectively of the extended J-slot for receiving the retriever unit thereunto.
Figure 4B:
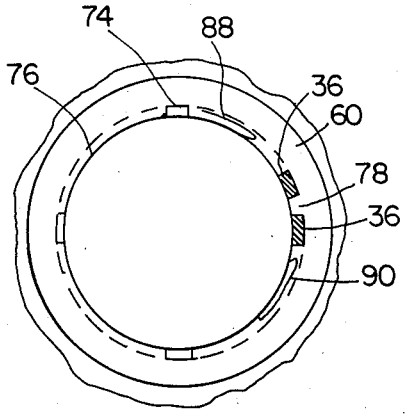

As is illustrated in FIGS. 4A and 4B, protruding members 36 on the exterior wall of retriever section 26 would align themselves with vertical slots 74 in the wall of the wear bushing 60 and engage therein. Upon positioning of the four protruding members 36 in the respective slots 74, the drill string would then be slightly rotated, thus imparting rotation movement to the sub-unit 13 itself, and due to the engagement of the intruding members 36 in the groove slots of the mandrel sections of sub-unit 13, the retriever section 26 would be likewise rotated. This rotation of the retriever section 26 would in effect slidably engage the protruding members 36 within the horizontal slots 76 of the wall of the wear bushing 60, and thus be in locked position for retrieval of the bushing 60 from the hole. Upon locking in the vertical slots, the drill string would then be "backed up" and the wear bushing retrieved out of the hole. Retrieval is also seen in FIG. 2 as bushing 60 has been retrieved from the hole. The wear bushing 60 would then be rotated a quarter turn in the opposite direction and the protruding members 36 would slip out of the vertical slots 74 and upon disengagement of the apparatus 10 from the drill string, the old worn wear bushing 60 removed, and a new wear bushing 60 would then be manually set upon the retriever section 26 and the process would be repeated except that the wear bushing 60 would then be lowered in the hole for replacement into operating position. As is illustrated in FIGS. 4A and 4B, the horizontal slots 76 could be continuous in the wall of bushing 60 with the exception of stop 78, which, when a protruding member 36 strikes the stop the members 36 are either locked in following clockwise rotation (arrow 88) of the members 36 to be on in position to be slipped out of vertical slots 74 following counterclockwise (arrow 90) rotation of the drill string.

What is critical about the entire operation is shown in the present state of the art as illustrated in U.S. Pat. No. 3,489,214. In the present state of the art, the retriever section would be rigidly engaged upon a section of drill pipe for retrieval of the wear bushing. This rigid connection in the present state of the art, is necessary so that the retriever section will not rotate while the protruding members are being aligned with the vertical slots in the wear bushing itself. However, with this rigid interconnection between the retriever section and the mandrel section of the drill pipe, the retriever section is therefore not free to have any vertical play at all. What results, then is when the retriever section makes contact with the wear bushing, if the protruding members are not properly aligned, the entire weight of the drill string may, and often does, crimp the walls of the wear bushing and, in effect, ruin any chance for retrieval of the bushing in this conventional manner.

With the present invention, the groove sections 40 and 42 in the walls of the mandrel 13, which are engaged by the insertion members 43 and 44 from the interior most wall of the retriever section, serve to allow the retriever section to have approximately 3 feet in vertical play while the protruding members 36 are being aligned with slots 74 of the wear bushing 60, yet having no free rotational movement. Therefore, should a first or second try in aligning the members 36 with slots 74 in the wear bushing 60 not occur, the weight of the drill string would not be imparted onto the wear bushing 60, since the retriever section 26 is free to "float" along the length of the mandrel section 13 of the sub-unit 12. This, in effect, would eliminate the problem of crimping the walls of the wear bushing 60 or damage to the unit itself due to the weight of the drill string imparted upon the rigidly connected retriever section 60 as is in the present state of the art.

Figure 5:
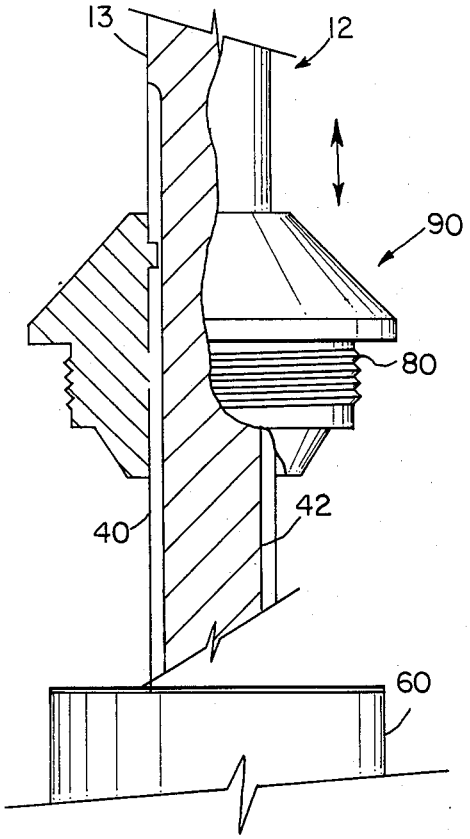
FIG. 5 illustrates a side view of an additional embodiment of the retriever unit of the apparatus of the present invention.

FIG. 5 illustrates an additional embodiment of the retriever section 90 of the apparatus 10 in side view. Rather than having the protruding members 36 for slidably engaging with the wear bushing 60, this particular embodiment would have a threaded lower end section 80 which would be adapted to retrieve a particular type of wear bushing, that type of wear bushing having a threaded collar section. Simply, the retriever section 90 would again be lowered into the hole, and upon contact of the retriever section 90 with the wear bushing, the drill string would be rotated and the threaded male end of the retriever section 90 would threadably engage the female end of the wear bushing, and the drill string could then be lifted out of the hole and the wear bushing retrieved in the process. The placement of this embodiment onto the drill string is precisely as described in the preferred embodiment, utilizing sub-unit 12, with the retriever section 90 being slidably attached to mandrel section 13 of sub-unit 12.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A floating wear bushing retreiver apparatus for retrieving wear bushing without imparting the weight of a drill string onto the wear bushing, said apparatus comprising:

a. a tool sub unit having a mandrel section with a longitudinal bore therethrough;

b. a retreiver section having an integral body and a bore therethrough for inserting onto said mandrel portion of said sub unit, the interior diameter of said bore of said retriever section being slightly larger than the exterior diameter of said mandrel portion of said sub unit and the exterior diameter of said retriever section being slightly smaller than the interior diameter of a wear bushing to be retrieved;

c. means on said mandrel portion of said sub unit for disallowing rotation of said retriever section around said mandrel portion, said means comprising a grooved portion along substantially the entire length of said tool sub unit and means communicating with said rotation disallowing means disposed on the interior wall of said retriever body;

d. means on the first and second ends of said sub unit for maintaining said retriever section on said sub unit between said end means;

e. means on said retreiver section for engaging said retriever section to the wear bushing to be retreived, said means comprising protruding members disposed symmetrically on said retriever section.

2. The apparatus in claim 1, wherein said means on the interior wall of said retreiver section would slidably engage said rotation disallowing means during operation.

3. The apparatus in claim 2, wherein said means communicating with said rotation disallowing means comprises at least one insertion member slidably engagable within said groove of said sub-body for disallowing the rotation of said retriever section around said sub-body, without rotation of said sub-body.

4. The apparatus in claim 1, wherein said retriever section moves freely along the length of said sub-body between said end means of said sub-body.

5. The apparatus in claim 1, wherein at least one of said end means disposed on the first and second ends of said sub-body is threadably engagable to said sub-body.

6. An apparatus for retrieving a wear bushing from within a well head, comprising:

a. an elongated body portion running substantially the length of said apparatus, said body portion having at least one notched groove within substantially its entire length, and said body portion further comprising:

i. an integrally attached collar section on at least one end of said body portion;

ii. a removable collar portion on the second end of said body portion;

iii. a substantially circular retriever section, said section having a bore therethrough for insertion onto said tool body portion, the interior diameter of said bore of said retriever section being slightly larger than the exterior diameter of said tool body portion, allowing relatively free vertical movement between said body section and said retriever section;

iv. said retriever section further comprising means on the wall of said retriever bore for slidably engaging said notched groove of said body section for disallowing rotational movement of said retriever section without rotation of said body portion;

v. said retriever section further comprising a plurality of protruding members on the exterior wall of said retriever section, said protruding members communicating with J-shaped recess located in the retriever portion of the wear bushing to be retrieved.

7. The apparatus in claim 6, wherein the means for slidably engaging the notched groove area of said elongated body portion comprises an insertion member substantially the width and depth of said notched groove for slidably engaging said groove.

8. The apparatus in claim 6, wherein the rotational movement of said retriever section is imparted only when rotational movement of said body portion is performed, so that said retriever section may not rotate freely.

9. The apparatus of claim 6, wherein retriever section moves freely along the length of said body portion, yet is disallowed rotational movement free of said body portion.

* * * * *